US006044600A

United States Patent [19]

McCollough

[11] Patent Number: 6,044,600

[45] Date of Patent: Apr. 4, 2000

[54] RETROFIT THRESHOLD

[75] Inventor: William F. McCollough, Laurel, Md.

[73] Assignee: Polytech Inc., Baltimore, Md.

[21] Appl. No.: 09/315,048

[22] Filed: May 20, 1999

Related U.S. Application Data

[60] Provisional application No. 60/092,523, Jul. 13, 1998.

[51] Int. Cl.[7] ..... E06B 1/70

[52] U.S. Cl. ..... 52/209; 52/211; 52/302.1

[58] Field of Search ..... 52/211, 209, 302.1

[56] References Cited

U.S. PATENT DOCUMENTS

| | | | |
|---|---|---|---|
| 665,918 | 1/1901 | Lisby . | |
| 767,615 | 8/1904 | Webber . | |
| 2,840,868 | 7/1958 | May . | |
| 4,492,062 | 1/1985 | Levenez . | |
| 4,673,517 | 6/1987 | Enjo et al. . | |
| 4,807,392 | 2/1989 | Kirk | 49/58 X |
| 5,283,977 | 2/1994 | Smith . | |
| 5,426,894 | 6/1995 | Headrick . | |
| 5,673,517 | 10/1997 | Stanclift . | |

FOREIGN PATENT DOCUMENTS

| | | | |
|---|---|---|---|
| 2589191 | 4/1987 | France | 52/211 |

*Primary Examiner*—Christopher T. Kent
*Attorney, Agent, or Firm*—Shoemaker and Mattare, Ltd.

[57] ABSTRACT

A threshold cover, made of aluminum or similar material, which is retrofit over an existing door threshold by sizing the cover to exactly match the exposed portion of the existing threshold, and then attaching it directly over the threshold. The threshold cover preferably has a non-skid surface, and may have an internal flange of its vertical leg to mechanically interlock with the front edge of the threshold. The cover may be formed in two articulating parts to accommodate non-planar thresholds. Weep channels in the bottom surface cover serve to drain water which may get under the cover.

9 Claims, 8 Drawing Sheets

RETROFIT THRESHOLD

This application claims priority from provisional patent application 60/092,523, filed Jul. 13, 1998.

BACKGROUND OF THE INVENTION

This invention relates to a retrofit threshold for an entry door.

A door assembly is comprised of a door, a pair of vertical jambs, a top frame member, and a threshold at the bottom. One or more sidelight casements, with their associated jambs, may be incorporated into the assembly adjacent the door. During construction of a new home, the door assembly is installed near the beginning of the construction process. Subsequent installation of brick, concrete, siding, roofing, and many other materials subjects the threshold to abnormal abuse. It is not unusual for the threshold to become damaged, as by denting, from the passage of heavy equipment and materials over it.

It is not a simple matter to replace a threshold, because this member extends under and is fastened to the bottom ends of the vertical jambs and any sidelight casement jambs. To do a proper replacement requires removing materials surrounding the assembly, such as brick, siding, trim drywall, and caulk, then removing the door and dismantling the frame.

Prior inventors have addressed the problem of threshold restoration generally. See, for example, U.S. Pat. Nos. 767,615, 2,840,868, 4,492,062, 5,283,977, 5,426,894 and 4,673,517. Also, some devices have been proposed to prevent snow or water from entering under the door. See U.S. Pat. No. 665,918, for example. None of these prior attempts, however, is sufficiently effective, simple, inexpensive, and easy to install, yet permanent. And the device shown in U.S. Pat. No. 665,918 must be removed before one can safely pass through the door.

It would be beneficial to homeowners and repairmen to be able to renew the appearance and functionality of the threshold without having to disturb brick, siding, trim, drywall, caulk, and paint, and without having to dismantle the door frame, or purchase a new one.

SUMMARY OF THE INVENTION

An object of the invention is to enable one to repair a damaged threshold without having to dismantle the door frame, or remove the existing threshold.

A further object is to provide a retrofit threshold which does not interfere with the swinging of existing entry and storm doors, or with the safe passage of people stepping over the threshold.

Yet another object is to provide a retrofit threshold with good slip resistance.

One other object is to drain water which falls on the retrofit threshold away from the house.

These and other objects are attained by a threshold cover, made of aluminum or the like, which is retrofit over an existing door threshold by sizing the cover to exactly match the exposed portion of the existing threshold, and then attaching it directly over the threshold. The threshold cover preferably has a non-skid surface, and may have an internal flange of its vertical leg to mechanically interlock with the front edge of the threshold. The cover may be formed in two articulating parts to accommodate non-planar thresholds. Weep channels in the bottom surface of the cover serve to drain water which may get under the cover.

BRIEF DESCRIPTION OF THE DRAWINGS

In the accompanying drawings.

DESCRIPTION OF THE PREFERRED EMBODIMENT

A retrofit threshold embodying the invention (FIGS. 1–3) is formed from an L-section piece of material 10, preferably an inexpensive non-corroding metal, such as aluminum. The section comprises a long leg 12 subsequently referred to as the "horizontal" leg (although in use it will have a slightly downward slope, toward the outside of the house, and a short substantially vertical leg 14. The material should be of a gauge sufficient to avoid denting or bending damage in normal use, although the existing threshold is expected to provide support from below. If the existing threshold "T" is structurally unsound, it should be replaced before proceeding, so that the threshold cover will be adequately supported. In general, the threshold cover should have a minimum thickness of one-sixteenth of an inch, to provide adequate strength, and a maximum thickness of about one-eighth of an inch, to preserve the original appearance and avoid interference with any storm door or screen door which may have been installed previously.

The threshold cover can be pre-cut in different sizes to fit common standard door frame designs. For non-standard door constructions, a slightly oversize threshold cover can be custom-cut at the job site to fit the door frame. Lines and other indicia (not shown) may be printed or embossed on the threshold cover to facilitate such cutting.

Figure 1:
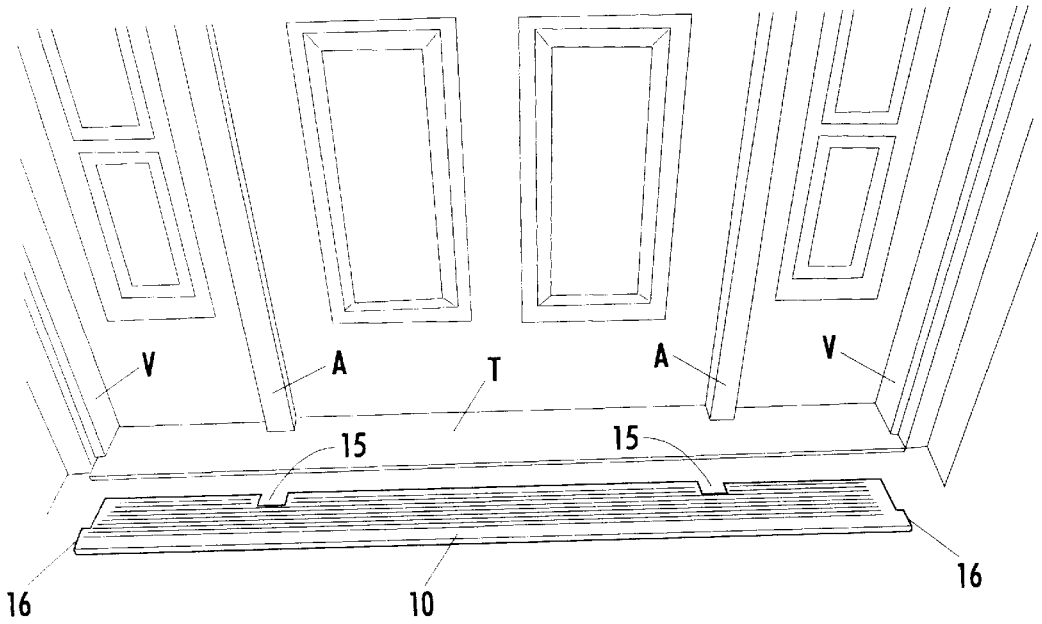
FIG. 1 is a perspective view of an entry door, looking downward from the outside of the house, showing a retrofit threshold embodying the invention in position for installation.

As FIG. 1 shows, the threshold cover is selected or cut so that it just fits over the existing threshold, and does not have to be placed under any of the vertical members "V" of the door frame. Note the reliefs 15 for the astragals "A" on either side of the entry door, in this case. The tabs 16 at the ends of the threshold cover extend into the areas in front of the trim members. This way, the exposed surface of the existing threshold is completely covered, without requiring the installer to undercut any existing part of the door frame. The illustration is merely exemplary: each cover is made to the exact shape of the exposed portion of the threshold being retrofit.

Figure 2:
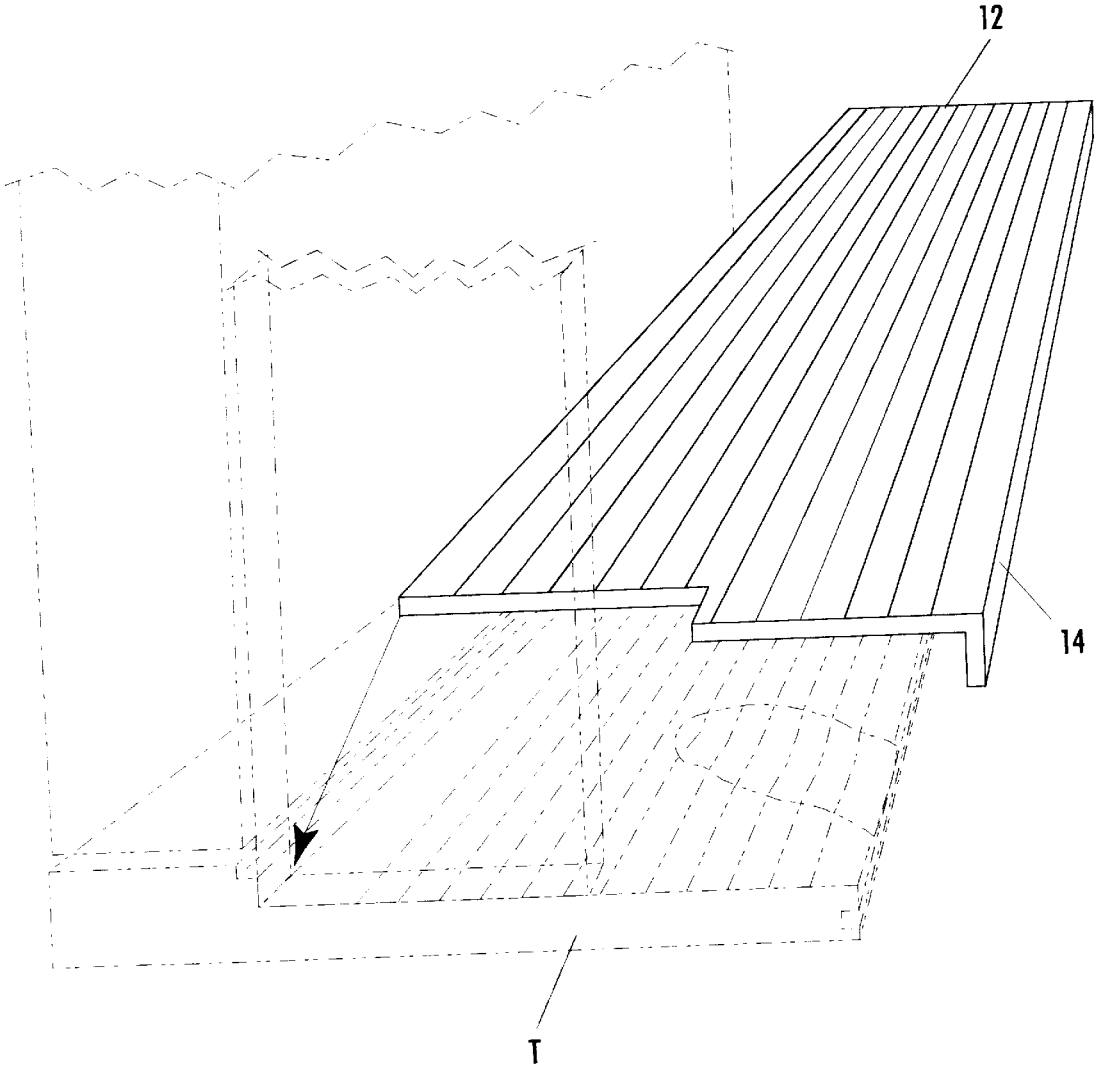
FIG. 2 is a perspective view from one side, showing the threshold cover being placed over the damaged original threshold.
Figure 3:
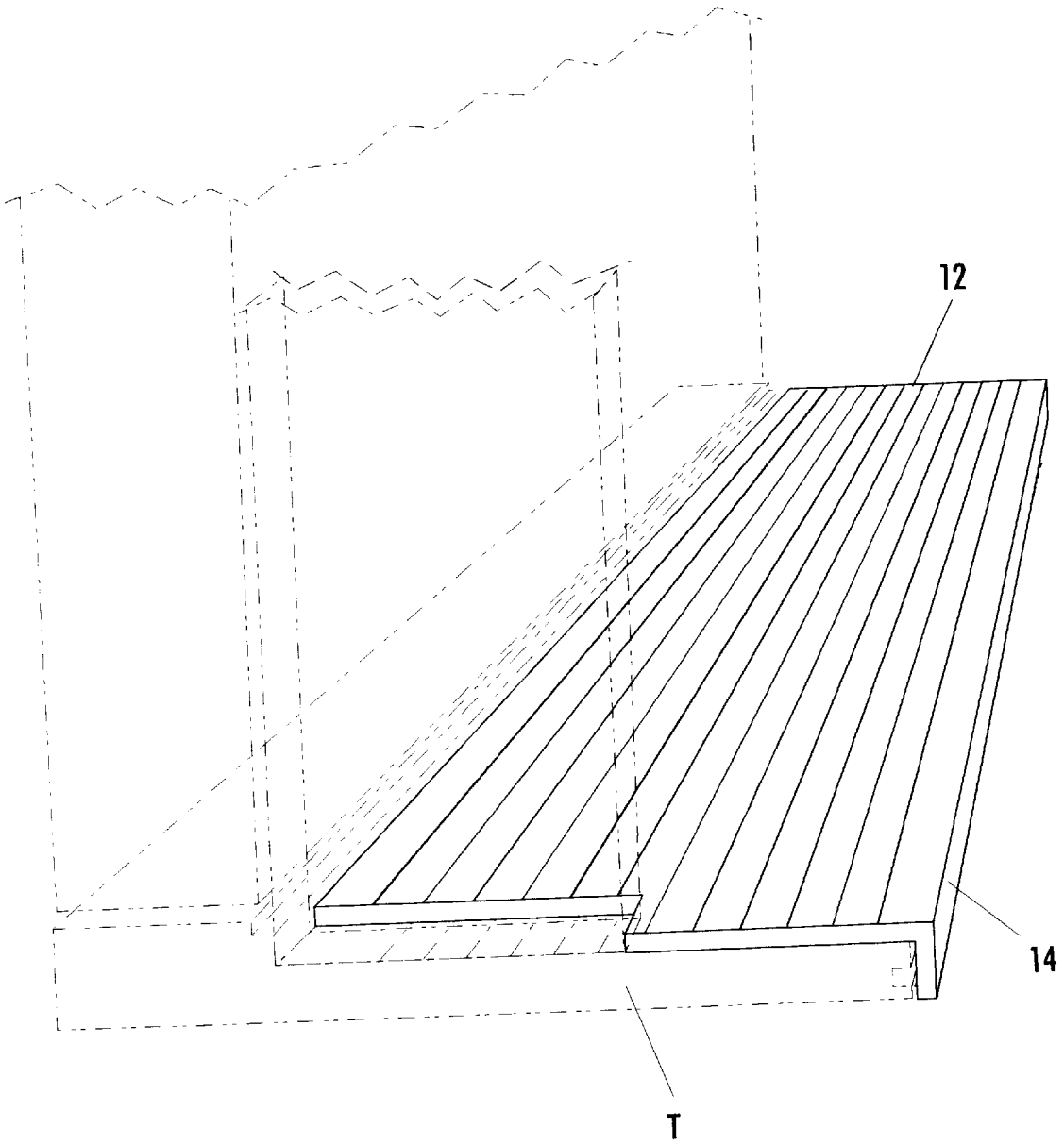
FIG. 3 is a view like FIG. 2, showing the threshold cover in place.
Figure 4:
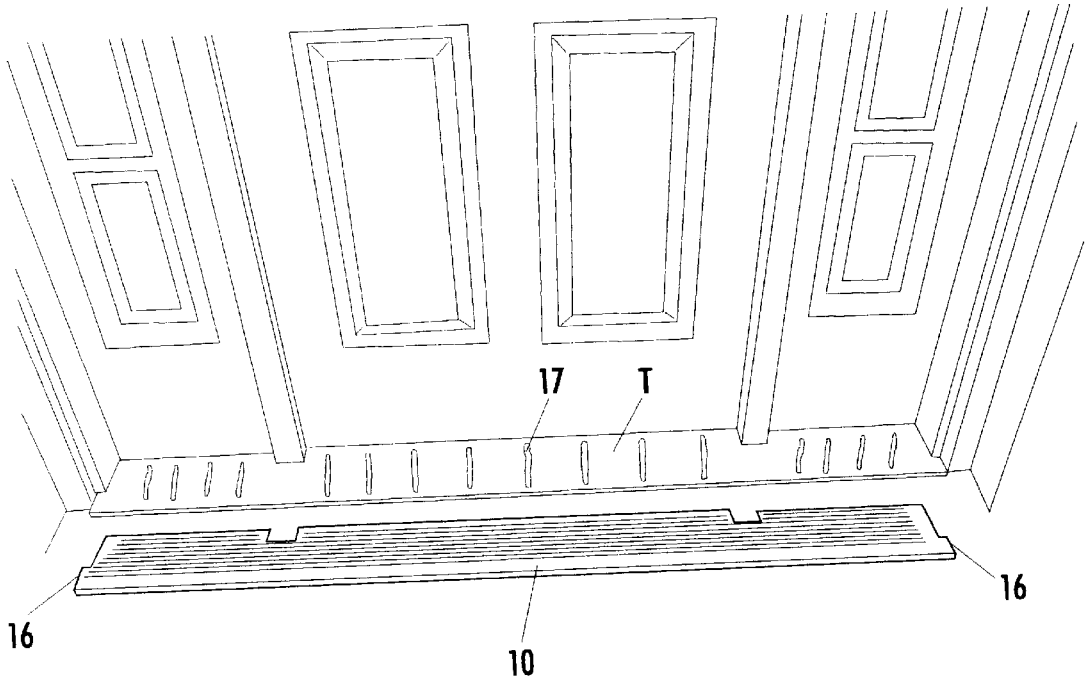
FIG. 4 is a view like FIG. 1, showing lines of adhesive on the old threshold.

As one can see in FIGS. 2 and 3, the threshold cover is placed flush against the existing threshold. The installer will want to remove nails or other objects protruding upward from the original threshold first, so that good surface-to-surface contact results. No particular method of attachment is shown, but adhesives are particularly contemplated. Several lines of adhesive 17 are illustrated in FIG. 4 as having been applied to the original threshold before the new one is placed over it. Countersunk screws or other suitable fasteners may be used as well, if desired. The installer should install a gasket or sealer around the side and rear edges of the threshold cover in moist situations, to keep the original threshold dry.

Figure 5:
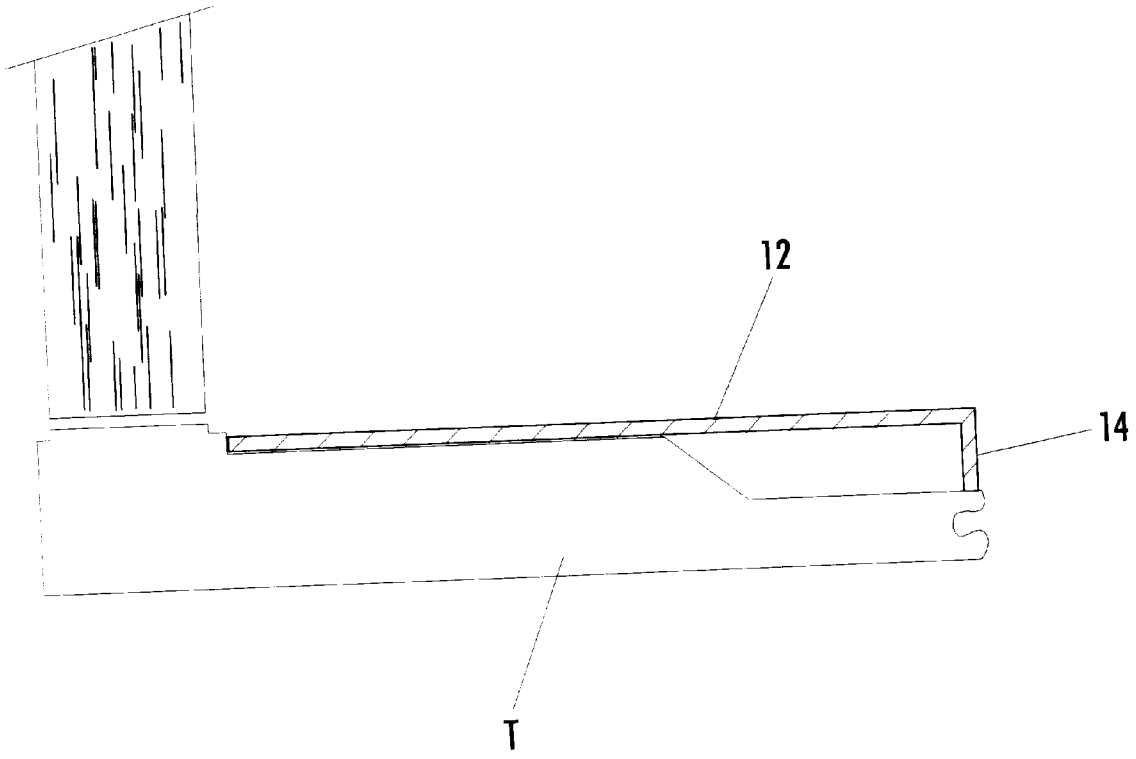
FIG. 5 is a side sectional view, showing the threshold cover in place on a stepped threshold.

In cases where the original threshold is non-planar, for example stepped, as shown in FIG. 5, the vertical flange 14 of the threshold cover may be installed standing upon the original threshold "T", rather than overlapping it. The flange height must of course be selected to provide the desired offset to optimize the surface contact between the new and old thresholds.

Figure 6:
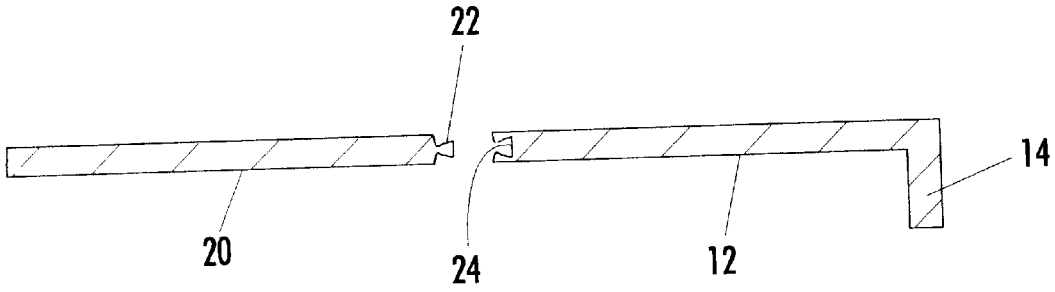
FIG. 6 is an exploded side sectional view of a modified form of the invention, wherein the threshold cover is formed in two parts having an interlocking articulated connection.
Figure 7:
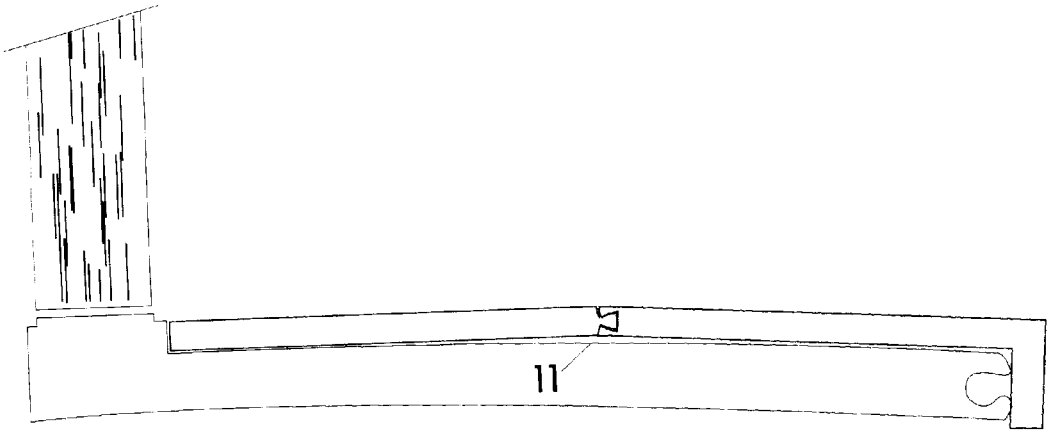
FIG. 7 shows the articulated threshold assembled and installed over a convex original threshold.

A slightly convex or concave threshold may be covered with an articulated threshold cover, as shown in FIGS. 6–7. This threshold has an inner flat element 20 formed with a tongue 22 along its front edge, and the outer element 12 is L-shaped, and has a complementary slot 24 along its rear edge. Preferably the groove and slot have interlocking geometries as exemplified by the dovetail design shown.

Figure 8:
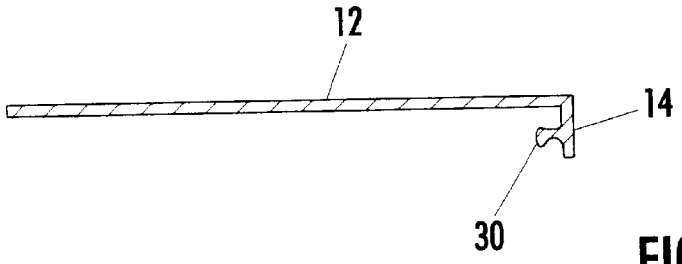
FIGS. 8–10 are side sectional views of a second modified form of the invention, wherein the threshold cover has a flange for seating in a groove extending along the front edge of the threshold.
Figure 9:
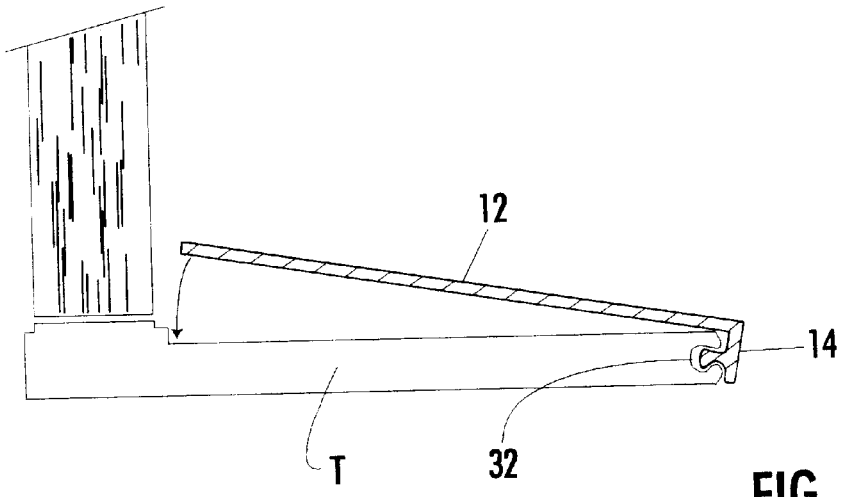
Figure 10:
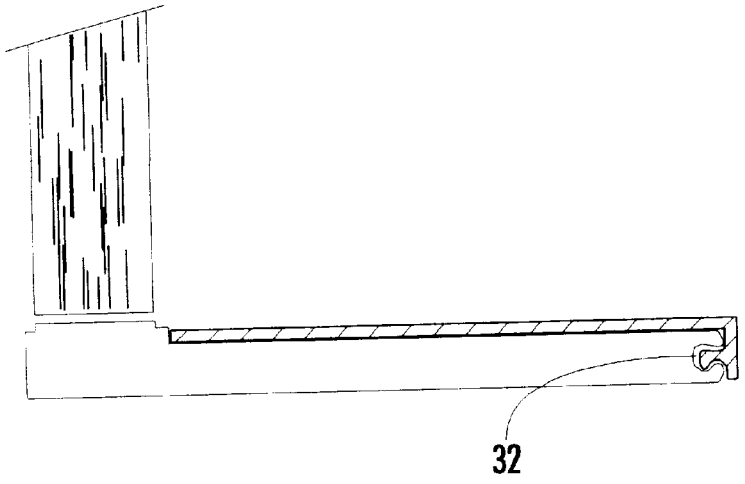

In another form of the invention (FIG. 8), the vertical leg 14 of the threshold cover has an internal horizontal flange 30 designed to fit in a corresponding groove 32 in the front edge of the original threshold "T". FIGS. 9 and 10 show the flanged threshold cover being placed onto the threshold. The advantage of this design is that the front edge of the threshold cover, which is subject to lifting if tripped upon, is mechanically locked to the original threshold.

Figure 11:
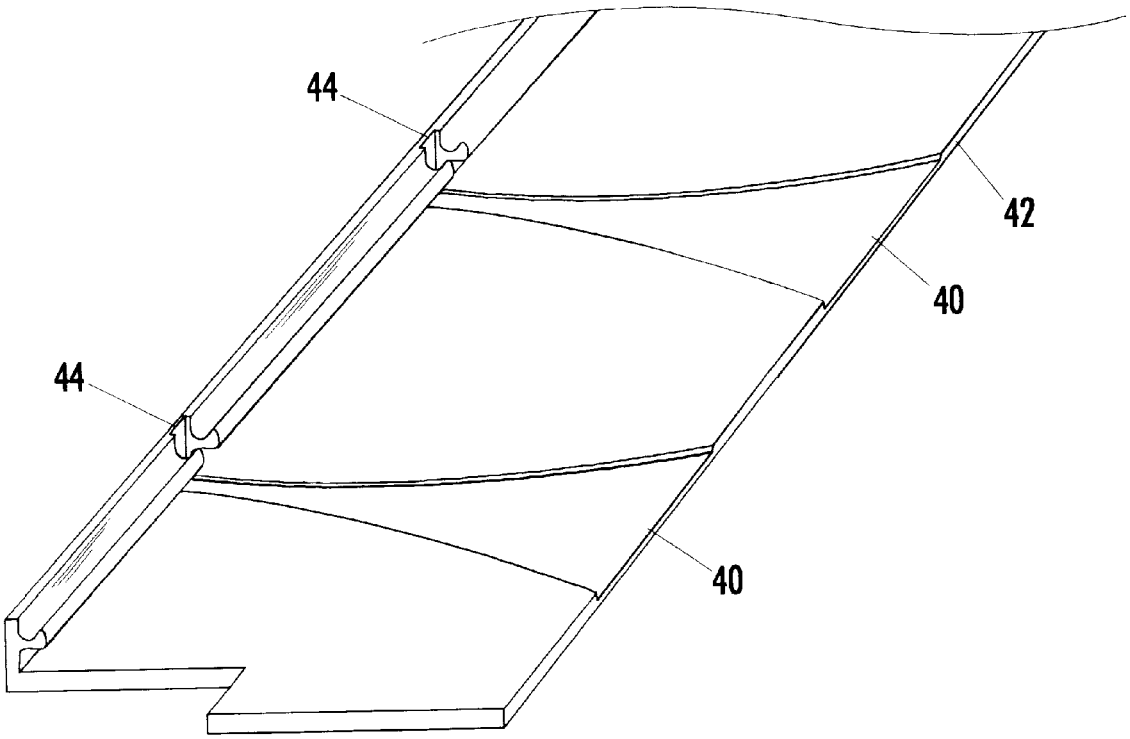
FIG. 11 shows the underside of a further modification, where the threshold cover has water channels on its bottom surface to drain water away from the door.

Weep channels 40, illustrated in FIG. 11, may be formed in any of the above forms of the invention. Such channels need be only deep enough to allow minor amounts of water which may get under the threshold cover to escape to the outside, it being understood that the original threshold has some slope in that direction. The weep channels could be of constant width, but I prefer they have a greater width at the inner edge 42 of the threshold cover than at the outer edge 44.

While we have described an aluminum threshold cover above, it should be understood that other materials may prove suitable, or even superior. In general, the material must have good appearance, corrosion resistance, abrasion resistance and adequate strength, all at a reasonable cost. Reinforced plastics and other non-metallic materials may be adequate. The choice of materials may depend on the weather at the location of the door being repaired, and the aesthetic effect desired.

Since the invention is subject to modifications and variations, it is intended that the foregoing description and the accompanying drawings shall be interpreted as only illustrative of the invention defined by the following claims.

I claim:

1. A retrofit threshold for installation over an existing door threshold, said retrofit threshold comprising a piece of generally L-section material having a substantially horizontal leg and a vertical leg, the horizontal leg adapted to have a pattern like that of the exposed portion of the existing threshold, and the vertical leg adapted to have a height sufficient to cover the front edge of the existing threshold, wherein the bottom surface of the horizontal leg has plural weep channels formed therein to allow water to escape from under the threshold cover.

2. The invention of claim 1, wherein the horizontal leg has ends formed with notches to avoid interference with existing vertical door jamb members.

3. The invention of claim 1, wherein the vertical leg has a horizontal inner flange to engage within a corresponding slot in the front edge of the existing threshold.

4. The invention of claim 1, wherein each channel has a width which decreases in the outside direction.

5. The invention of claim 1, wherein the horizontal leg is formed in two portions having an articulating joint between them, so as to accommodate concave and convex thresholds.

6. The invention of claim 5, wherein the articulating joint is an interlocking joint.

7. The invention of claim 6, wherein the interlocking articulating joint is a dovetail joint.

8. A method of renewing an existing door threshold, comprising steps of providing a threshold cover comprising a substantially horizontal leg and a vertical leg, shaping the horizontal leg so that it conforms to the upper surface of the existing threshold, and attaching the threshold cover to the upper surface of the existing threshold.

9. The invention of claim 8, wherein the attaching step is carried out with an adhesive.

* * * * *